US010501249B2

(12) United States Patent
Mazurkiewicz et al.

(10) Patent No.: US 10,501,249 B2
(45) Date of Patent: Dec. 10, 2019

(54) FITMENT FOR A FLEXIBLE CONTAINER

(71) Applicant: AptarGroup, Inc., Crystal Lake, IL (US)

(72) Inventors: Timothy M. Mazurkiewicz, Milwaukee, WI (US); Dave S. Johnson, Colgate, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 0 days.

(21) Appl. No.: 16/158,466

(22) Filed: Oct. 12, 2018

(65) Prior Publication Data

US 2019/0039801 A1 Feb. 7, 2019

Related U.S. Application Data

(63) Continuation of application No. 15/122,850, filed as application No. PCT/US2014/039698 on May 28, 2014, now Pat. No. 10,138,043.

(51) Int. Cl.

| | |
|---|---|
| ***B65D 75/58*** | (2006.01) |
| ***B65D 47/08*** | (2006.01) |
| ***B65D 47/10*** | (2006.01) |
| ***B65D 51/22*** | (2006.01) |
| ***B65D 35/02*** | (2006.01) |

(Continued)

(52) U.S. Cl.

CPC ..... *B65D 75/5883* (2013.01); *B65D 35/02* (2013.01); *B65D 35/44* (2013.01); *B65D 43/26* (2013.01); *B65D 47/0809* (2013.01); *B65D 47/0857* (2013.01); *B65D 47/103* (2013.01); *B65D 51/20* (2013.01); *B65D 51/228* (2013.01); *B65D 2251/009* (2013.01); *B65D 2251/0018* (2013.01); *B65D 2251/0025* (2013.01);

(Continued)

(58) Field of Classification Search

CPC .... B65D 35/02; B65D 35/44; B65D 47/0857; B65D 47/103; B65D 51/20; B65D 75/5861; B65D 75/5872; B65D 75/5883; B65D 2251/0025; B65D 2251/0028; B65D 2251/009; B65D 2251/0018

See application file for complete search history.

(56) References Cited

U.S. PATENT DOCUMENTS

| | | | |
|---|---|---|---|
| 6,000,848 | A | 12/1999 | Massioui |
| D576,875 | S | 9/2008 | Steiger et al. |

(Continued)

FOREIGN PATENT DOCUMENTS

| | | | |
|---|---|---|---|
| CN | 101014507 | A | 8/2007 |
| JP | 10086951 | A | 4/1998 |
| WO | 99/62785 | A1 | 12/1999 |

*Primary Examiner* — J C Jacyna

(74) *Attorney, Agent, or Firm* — Wood, Phillips, Katz, Clark & Mortimer

(57) ABSTRACT

A fitment (20, 20A) is provided for a flexible, collapsible container (22) with an opening. The fitment (20, 20A) has a body (24, 24A) with an inner end (31) and an outer end (32) and an access passage (30) for communicating with an interior of the container (22). The body (24, 24A) has a height defined between the inner end (31) and outer end (32). The body (24, 24A) has a sealing portion (36, 36A) for being attached to the interior of the container (22). The sealing portion (36) has a major dimension (MD) oriented generally transverse of the height of the body (24, 24A). The fitment (20, 20A) further has a pour lip (46, 46A) that extends from the body outer end (32) and projects laterally relative to the access passage (30). The pour lip (46, 46A) defines a pour path (PP).

4 Claims, 13 Drawing Sheets

(51) Int. Cl.
*B65D 35/44* (2006.01)
*B65D 43/26* (2006.01)
*B65D 51/20* (2006.01)

(52) U.S. Cl.
CPC ..... *B65D 2251/0028* (2013.01); *B65D 2251/0093* (2013.01)

(56) References Cited

U.S. PATENT DOCUMENTS

| | | | |
|---|---|---|---|
| D628,893 | S | 12/2010 | Groubert et al. |
| 8,113,374 | B2 | 2/2012 | Steiger et al. |
| D682,101 | S | 5/2013 | Mazurkiewicz |
| 8,678,215 | B2 | 3/2014 | Steiger |
| 8,870,026 | B2 | 10/2014 | Kasai |
| 2005/0205618 | A1 | 9/2005 | Mabee |
| 2008/0017665 | A1 | 1/2008 | Brecheisen |
| 2008/0063319 | A1 | 3/2008 | Kuge |
| 2010/0140266 | A1 | 6/2010 | Lohrman et al. |
| 2014/0263474 | A1 | 9/2014 | Skillin et al. |
| 2014/0312078 | A1 | 10/2014 | Fitzsimmons et al. |
| 2015/0060457 | A1 | 3/2015 | Van Der Molen |
| 2015/0360820 | A1 | 12/2015 | Akutsu |

FITMENT FOR A FLEXIBLE CONTAINER

BACKGROUND OF THE INVENTION

Technical Field

This invention relates to a fitment for a flexible, collapsible container such as a pouch, bag, etc.

Technical Problems Posed by the Prior Art

A fitment is typically employed to permit communication between the exterior and interior of a flexible, collapsible container such as a pouch, bag, etc. Various substances (including lotions, creams, food items, granules, liquids, powders, small articles, etc.) may be packaged in a flexible, collapsible container having a fitment that can be opened and closed. Such a container, with the fitment mounted thereon and the contents stored therein, may be characterized as a "package."

A typical fitment is a separate structure for being attached to the flexible, collapsible container at an opening in the container, and has a body that defines at least one access passage through the body for communicating with the container interior through the container opening.

A fitment for use with a flexible, collapsible container may have a body that includes a base that is specially shaped for being attached at the opening of the container. Such a base may be boat-shaped or elongate such that it has a "length" which may be characterized as a major dimension. The base of the fitment is typically sealed within the container while a portion of the fitment body, such as a neck, extends outwardly from the base beyond the container opening. The body access passage extends through both the base and neck.

In some applications, a closure in the form of a lid (e.g., cap or cover or hinged lid) can be provided as part of the fitment to accommodate movement relative to the fitment body access passage between (1) a fully closed position occluding the access passage, and (2) an open position at least partially exposing the access passage. In other applications, a separate closure can be provided with (1) a base that (a) is installed on the neck or analogous distal end of the fitment, and (b) defines a flow passage therethrough, and (2) a lid connected to the closure base.

Instead of, or in addition to, employing a closure on the fitment, the fitment may include an initial hermetic seal and/or may include an initial tamper-evidency feature for indicating to a user if the fitment integrity has been compromised. One type of such a fitment includes a body having an upper portion or neck defining at least part of the access passage which is initially sealed closed with a separable membrane. The outer, or discharge, end of the neck may be covered with a lid that can be removed, or moved away, from the neck so as to "open" the neck and allow access to the separable membrane. Typically, a separation member, such as a pull tab or pull ring, extends from the membrane. The pull tab or ring projects from and above the membrane within the neck. The user initially opens the lid, and then grasps the pull tab or ring to pull the membrane so as to separate the membrane from the neck to establish communication between the exterior ambient environment and the interior of the container to which the fitment is mounted.

A flexible, collapsible container of fluid can be difficult for a user to hold, handle, and manipulate. It can be somewhat difficult or inconvenient to pour a liquid, or other substance, from such a flexible, collapsible container. The inventors of the present invention have determined that it would be desirable to provide an improved fitment for a flexible, collapsible container which could facilitate a user more easily pouring a substance from the flexible, collapsible container.

The inventors of the present invention have also determined that it would be beneficial if an improved fitment could be provided for a flexible, collapsible container wherein the improved fitment could be relatively easy to manufacture and installed on the container.

The inventors of the present invention have also determined that it would be desirable to provide a novel package that includes a flexible, collapsible container containing a substance and that includes an improved fitment in an opening to the container interior through which the substance can be poured.

The inventors of the present invention have further determined that it would be beneficial if the user could employ a method of pouring a substance from a flexible, collapsible container in a manner that would allow the user to more easily hold the container and to more easily pour the substance from the container in a way that accommodates pouring of the substance in a desired path and/or toward a desired target region while minimizing inaccuracy of pouring and/or undesired splashing.

The inventors of the present invention have invented a novel structure for a fitment for a flexible, collapsible container wherein the fitment includes advantageous features not heretofore taught or contemplated by the prior art.

SUMMARY OF THE INVENTION

The invention, and particularly a preferred embodiment of the invention, provides various structural and operational advantages.

According to broad aspects of one form of the present invention, a fitment is provided for use with a flexible, collapsible container having an opening to the container interior. The fitment has an elongate body for being sealed at the opening of the flexible, collapsible container. The body has an inner end, an outer end, and a height defined between the inner end and the outer end. The body further has an access passage extending between the inner end and the outer end for communicating with the container interior. The body has a sealing portion for being attached to the container interior. The sealing portion has a major dimension generally oriented transversely of the height. The fitment further has a pour lip that extends from the outer end of the body, projects laterally relative to the access passage, and defines a pour path.

According to broad aspects of another form of the present invention, a package is provided for containing a substance that a user can pour. The package has a flexible, collapsible container with an opening to an interior of the container. The package further has a fitment positioned at the opening of the container. The fitment has an elongate body with an inner end, an outer end, and a height defined between the inner end and the outer end. The body has an access passage extending between the inner end and the outer end for communicating with the container interior. The body has a sealing portion that is sealed to the container at the container opening, and the sealing portion has a major dimension oriented generally transversely of the height. The fitment further has a pour lip that extends from the body outer end, projects laterally relative to the access passage, and defines a pour path.

According to broad aspects of another form of the present invention, a method of pouring a substance from a package is provided. The package includes a flexible, collapsible container with an opening to an interior of the container and a fitment sealed to the container at the opening. The fitment has an elongate body, wherein the body has an inner end, an outer end, a height defined between the inner end and the outer end, an access passage extending between the inner end and the outer end for communicating with the container interior, and a sealing portion that is sealed to the container at the container opening. The sealing portion has a major dimension oriented generally transversely of the height. The fitment also has a pour lip that extends from the body outer end, projects laterally relative to the access passage, and defines a pour path. The method includes a step of gripping the package on opposing sides of the major dimension. The method includes a further step of tipping the package such that the fitment major dimension and the pour path are defined by a plane that is parallel to the direction of gravity to pour the substance from the pour lip of the fitment in a direction generally in the plane.

It should be appreciated that the invention may include any or all of the above-described features, include only one of the above features, more than one of the above features, and any combination of the above features. Furthermore, other objects, features and advantages of the invention will become apparent from a review of the entire specification including any appended claims and drawings.

BRIEF DESCRIPTION OF THE DRAWINGS

In the accompanying drawings forming part of the specification, in which like numerals are employed to designate like parts throughout the same.

FIG. 10A shows the fitment in the closed condition;

FIG. 11 shows the fluent contents of the package being poured from the package.

DESCRIPTION OF THE PREFERRED EMBODIMENTS

Figure 1:
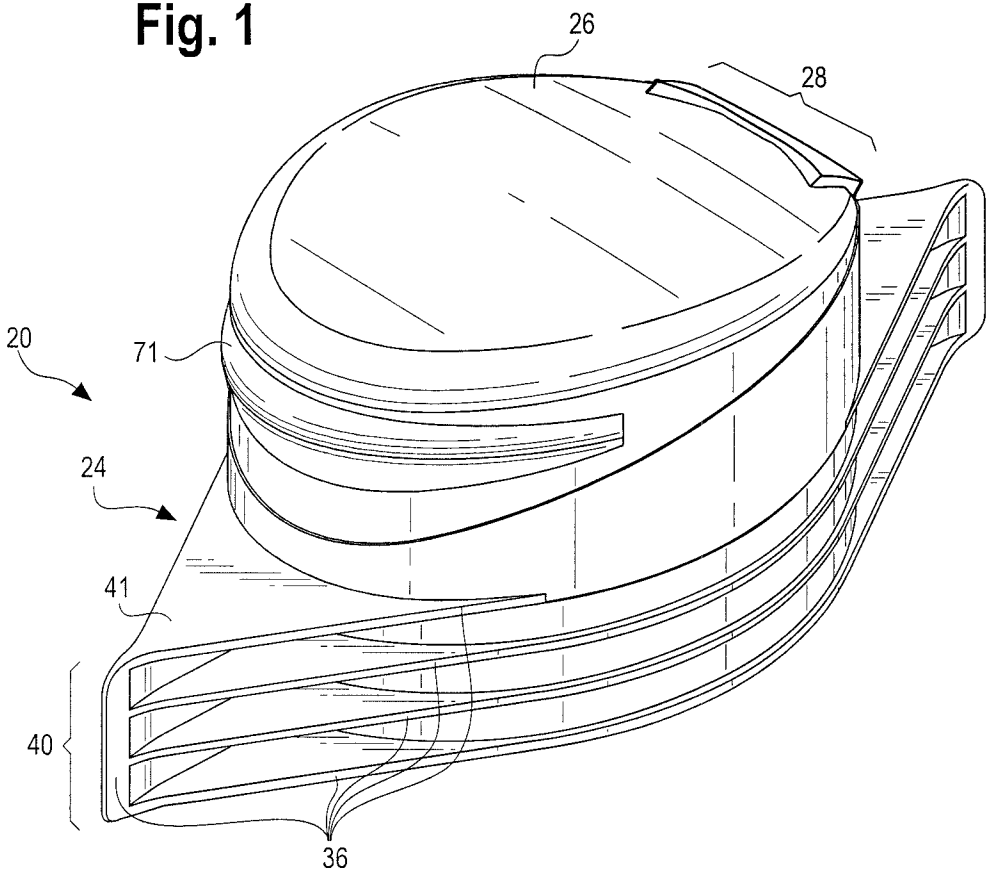
FIG. 1 is an isometric view, from the top front and side, of an embodiment of a fitment of the present invention shown in a closed condition prior to the fitment being installed in a flexible, collapsible container in the form of a pouch (not shown in FIG. 1)

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, many figures illustrating the invention show embodiments in the typical orientation that the fitment would have at the opening of a system in the form of an upright flexible, collapsible container, and terms such as upper, lower, horizontal, etc., are used with reference to this orientation. It will be understood, however, that the fitment of this invention may be manufactured, stored, transported, used, and sold in an orientation other than the orientations described.

The fitment of this invention is suitable for use with a variety of conventional or special containers, the details of which, although not fully illustrated or described, would be apparent to those having skill in the art and an understanding of such containers. It will also be understood by those of ordinary skill that novel and non-obvious inventive aspects are embodied in the described exemplary fitment alone.

The fitment is especially suitable for use on a flexible, collapsible container that contains a material or substance in the form of a product (e.g., a comestible substance or lotion) that can be poured from the system through the opened fitment. The product may be, for example, a fluent material such as a liquid, cream, powder, slurry, or paste. If the container and fitment are large enough, then the product could also be discrete pieces of material (e.g., food products such as nuts, candies, crackers, cookies, etc. or non-food products including various items, particles, granules, etc.) which can be poured out of the container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

A first preferred embodiment of a fitment of the present invention is illustrated in FIGS. 1-11 wherein the fitment is designated generally by reference number 20. Another embodiment of the fitment is designated generally by reference number 20A illustrated in FIG. 12 and is discussed in detail below. In the illustrated first embodiment, the fitment 20 is provided in the form of a separate fitment which is adapted to be attached to a container in the form of a flexible, collapsible bag or pouch 22 (FIG. 10A) that would typically contain contents such as a product or products consisting of articles or fluent material that can be poured from the pouch 22.

The pouch 22 may be made from a material suitable for the intended application (e.g., a thin, flexible material such as a polyethylene terephthalate (PET) film or a polyethylene film and/or an aluminum foil).

Typically, after the fitment manufacturer makes the fitment 20 (e.g., by molding the fitment 20 from a thermoplastic polymer), the fitment manufacturer will then ship the fitment 20 to a pouch filler facility at another location where the pouch 22 (FIG. 10A) is either manufactured or otherwise provided, and where the pouch 22 is filled with a product. The fitment 20 can be attached to the pouch 22 as the pouch 22 is being made and filled, or as the pouch 22 is being made but before the pouch 22 is subsequently filled through the open fitment 20 or through open regions of the pouch walls that are later sealed closed.

More specifically, in the illustrated first embodiment, the fitment 20 is provided as a separately manufactured article, component, or unit for being non-removably, and sealably, attached (e.g., heat sealed) to the pouch 22 (FIG. 10A) to provide a leak-tight assembly. The illustrated first embodiment of the fitment 20 is adapted to be attached to the upper end of the pouch 22 at an initial opening in the pouch which is sealed tight around the fitment 20 so that the fitment 20 can provide access to the pouch interior and to the contents (e.g., a product contained therein) after a portion of the fitment 20 is opened as described hereinafter. It will be appreciated, however, that in some applications (not illustrated), it may be desirable for the fitment 20 to be attached to a flexible, collapsible container in a leak-tight manner that would still allow a user to remove the fitment 20 from the container.

The pouch upper end portion or other suitable structure of the pouch 22 typically has a configuration with which the fitment 20 is adapted to engage. The remainder of the pouch 22 may have another configuration that differs from the configuration of the pouch upper end portion at the pouch opening. On the other hand, the pouch 22 may instead have a substantially uniform shape along its entire length or height without any portion of reduced size or different cross-section.

The particular embodiment of the fitment 20 illustrated in the FIG. 1 is especially suitable for use with a pouch 22 having a flexible wall or walls that can accommodate the user gripping the pouch (and optionally squeezing the pouch), and then tipping the pouch to pour the contents (e.g., the product) out through the opened fitment 20.

Figure 2:
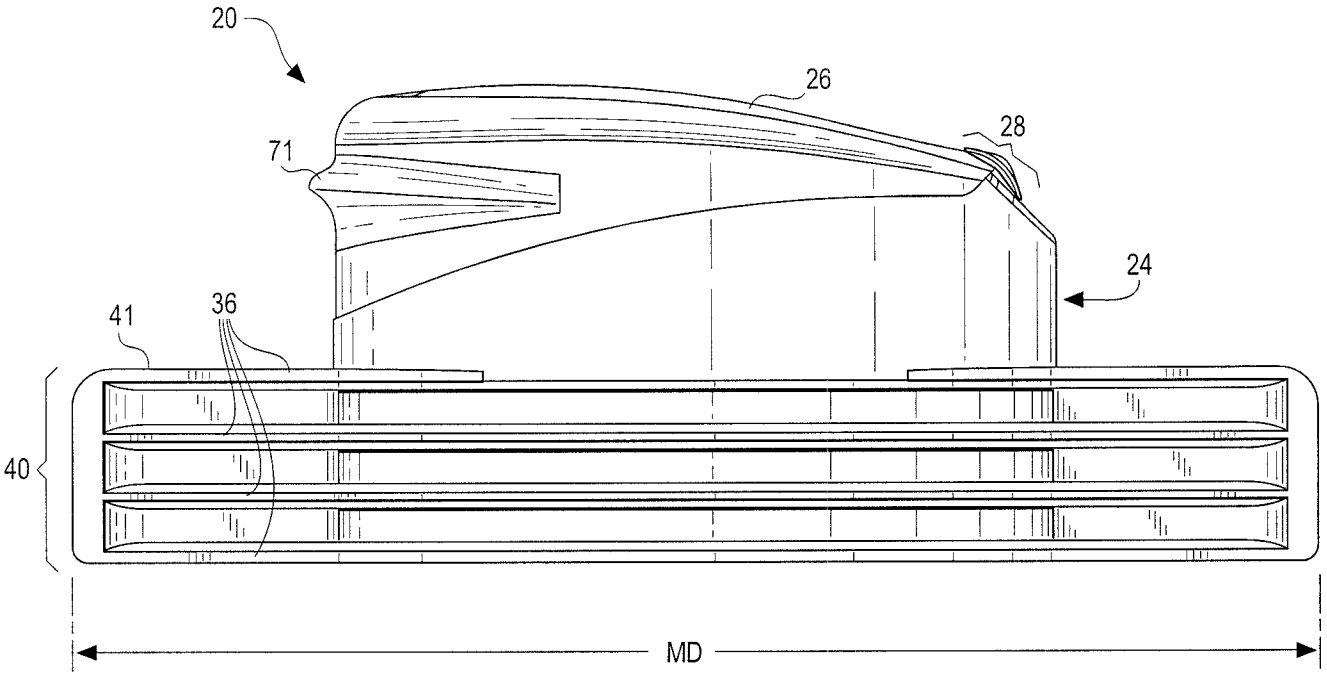
FIG. 2 is a side elevational view of the closed fitment shown in FIG. 1.
Figure 3:
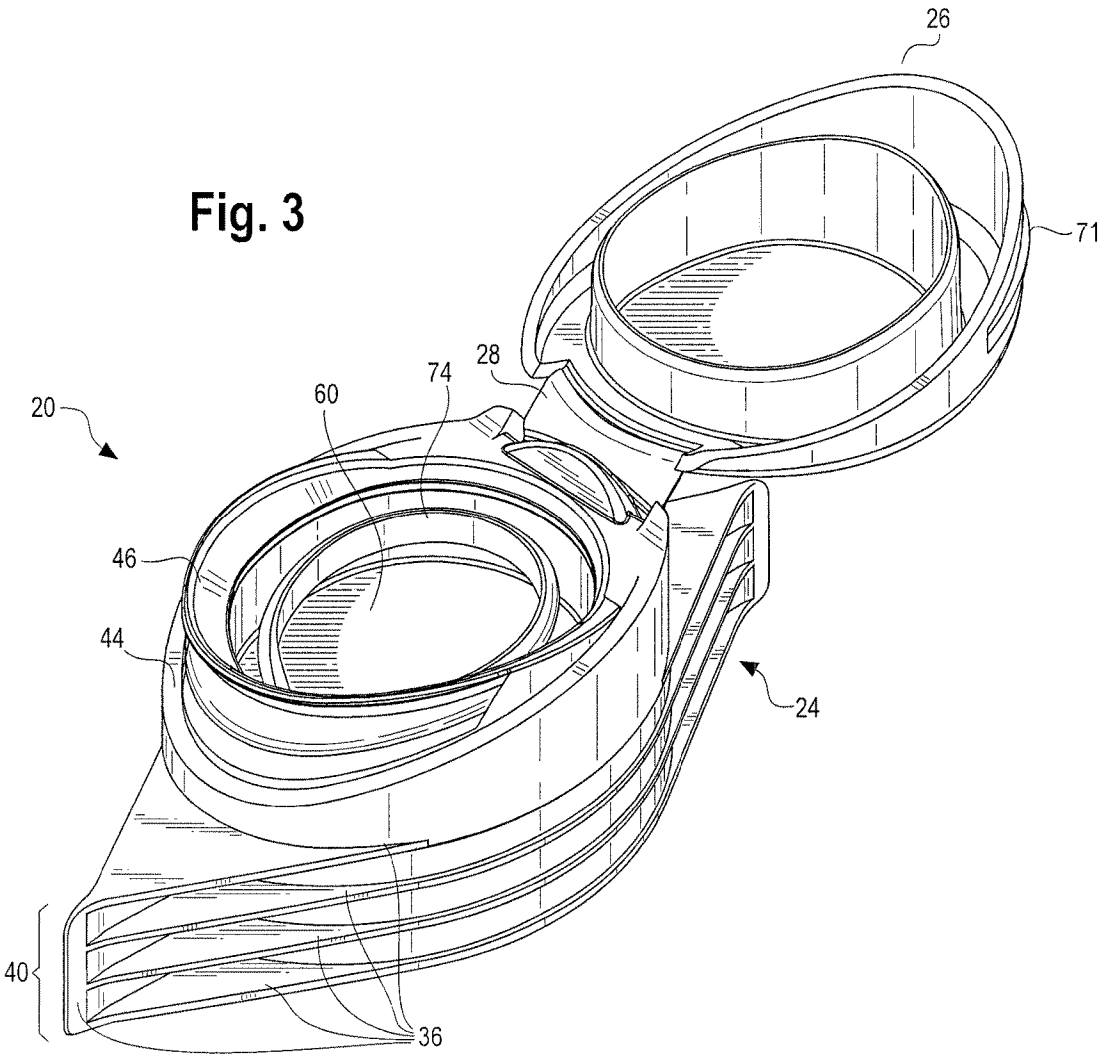
FIG. 3 is an isometric view of the fitment shown in FIG. 1, but FIG. 3 shows the fitment with the lid open in the as-molded condition prior to the lid being closed and the fitment installed in a pouch.
Figure 4:
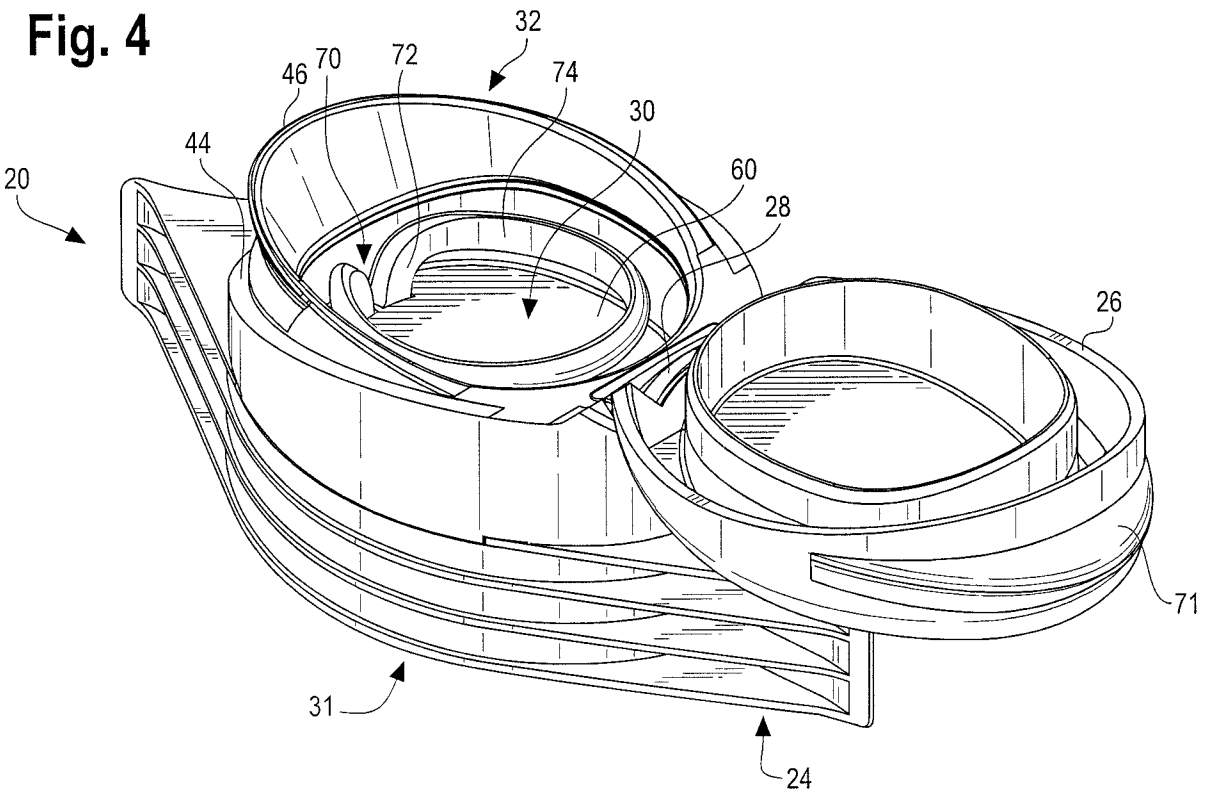
FIG. 4 is an isometric view of the fitment shown in FIG. 3 taken from the top rear and side of the fitment shown in the FIG. 3.
Figure 5:
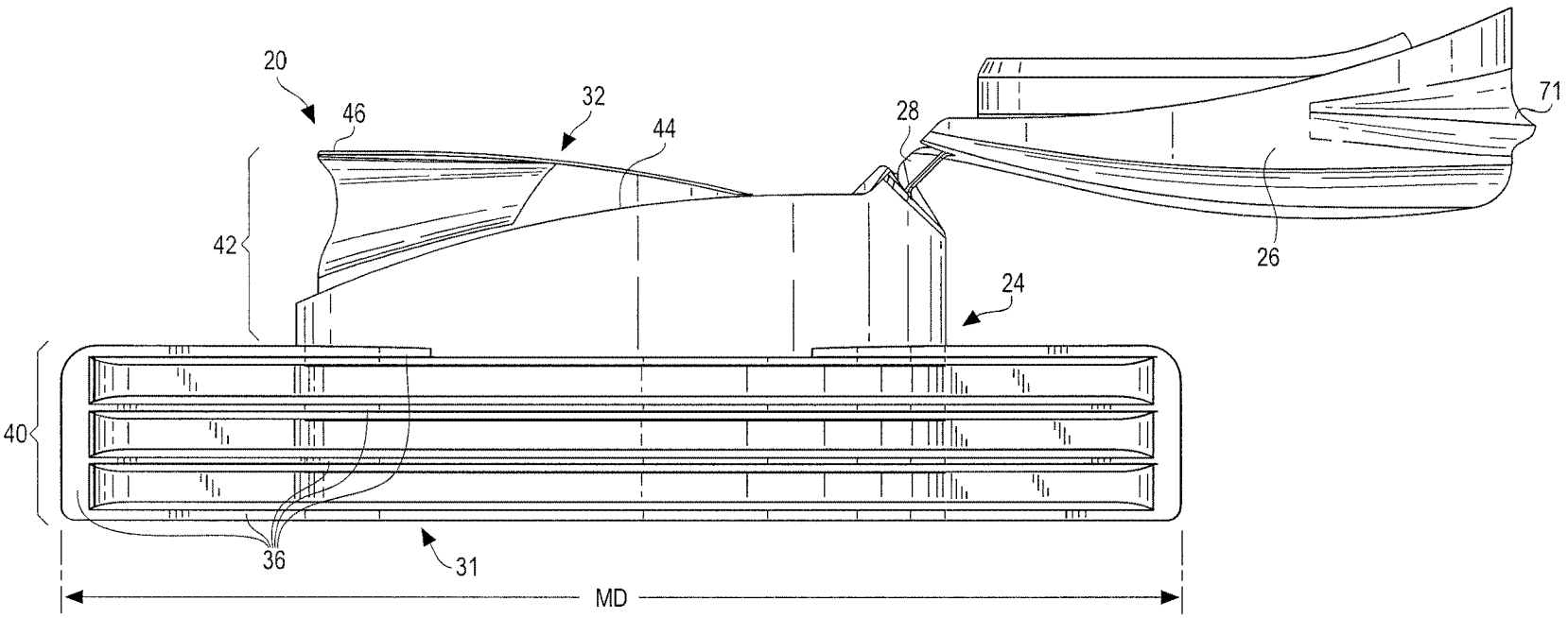
FIG. 5 is a side elevational view of the open lid fitment shown in FIG. 3.

In the first embodiment illustrated in FIGS. 1-11, the fitment 20 includes a body 24, a lid 26, and a connecting structure in the form of a hinge 28 which connects the body 24 and lid 26 (as best shown in FIGS. 3 and 5). The fitment body 24, lid 26, and hinge 28 are preferably molded as a unitary structure from a suitable thermoplastic material such as polyethylene, polypropylene, or the like. In a presently preferred form of the fitment 20, the body 24, lid 26, and hinge 28 are molded as one unitary structure from polyethylene. Other materials may be employed instead.

The hinge 28 may be of any suitable type. One form of a hinge 28 that may be used is the over-center, snap-action type hinge (e.g., see U.S. Pat. Nos. 5,642,824 and 6,321,923). Other types of hinges could be used. In some applications, the hinge 28 could be omitted altogether, and the lid 26 need not be connected as a unitary part of the fitment body 24. In alternative embodiments (not illustrated), the lid 26 may be a separate snap-on or screw-on component adapted to be mounted to, and completely removed from, the fitment body 24, or the lid 26 may be tethered to the fitment body 24 with a strap. In some applications, the lid 26 may be omitted altogether.

Figure 8:
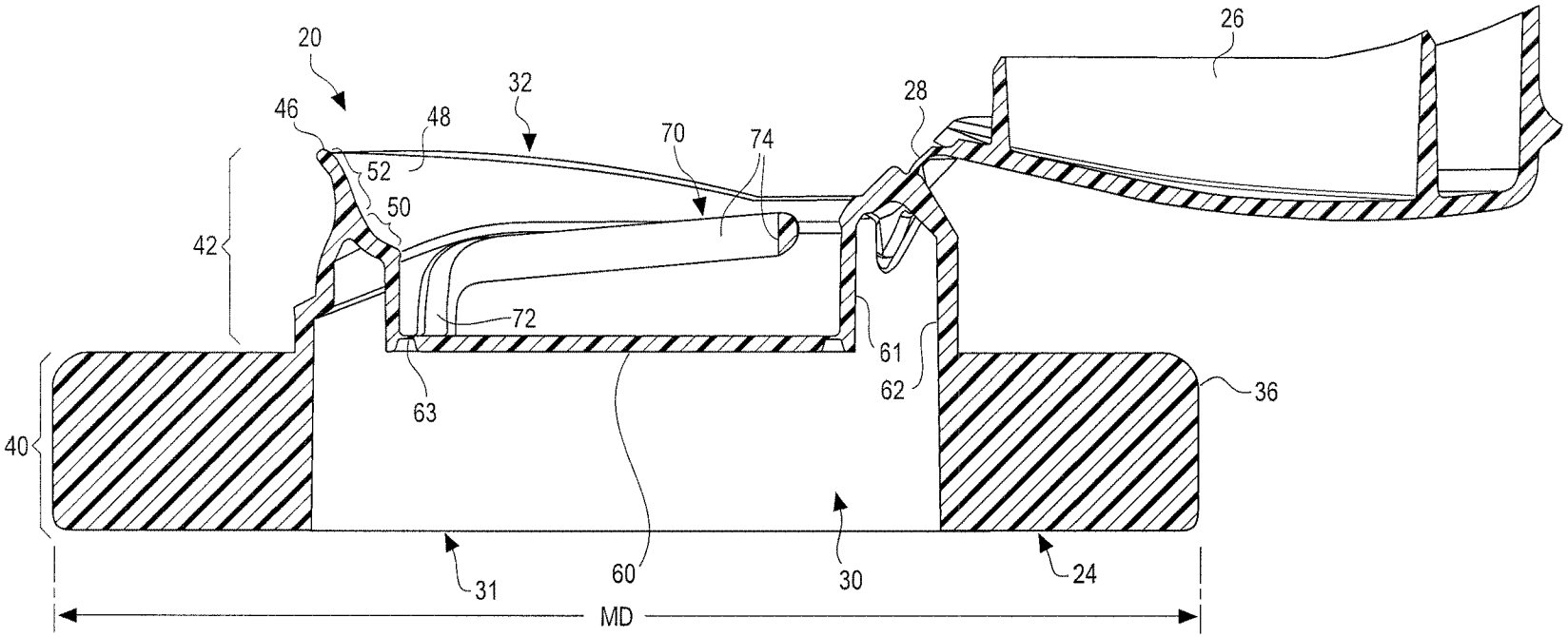
FIG. 8 is a cross-sectional view of the open lid fitment shown in FIG. 3 taken generally along the plane 8-8 in FIG. 6.

In the illustrated first embodiment of the fitment 20, the lid 26 accommodates movement relative to the body 24 between (a) a closed position on the body 24 (as shown in FIGS. 1 and 2) and (b) an open position (FIGS. 3 and 5) which, as shown in FIG. 8, permits greater access to an access passage 30 in the body 24.

Figure 10:
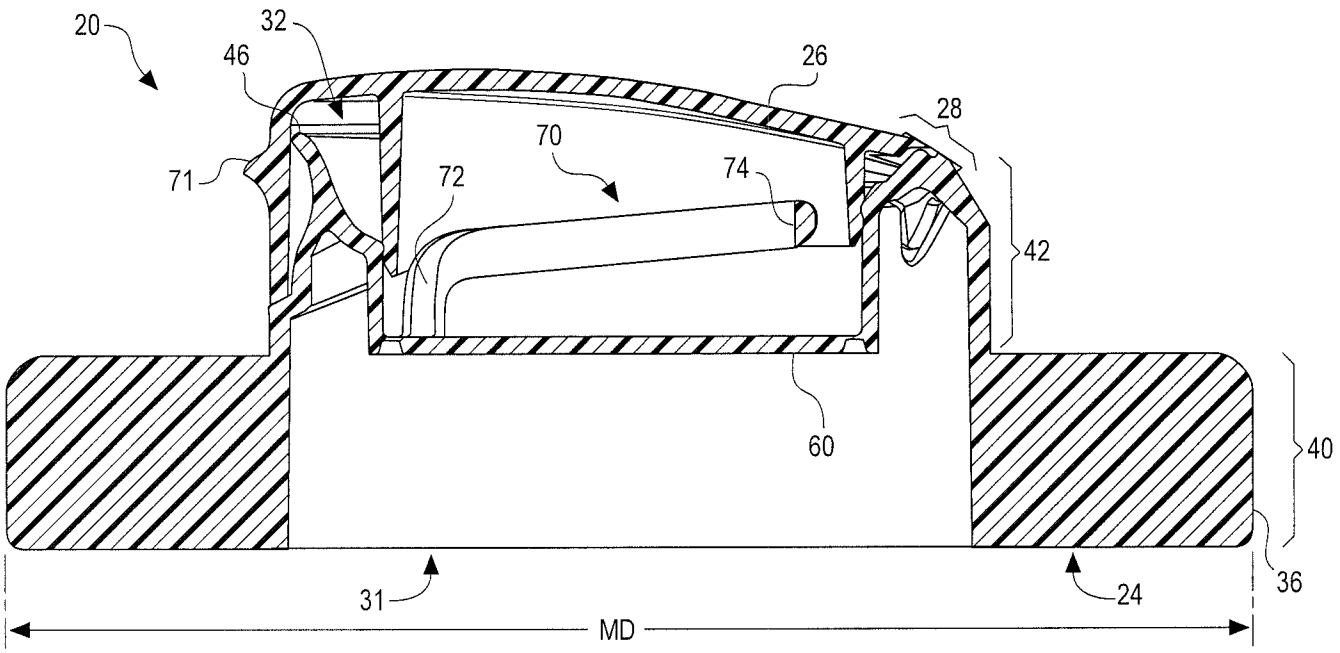
FIG. 10 is a cross-sectional view that is similar to the view in FIG. 8, but in FIG. 10 the lid of the fitment is shown in the closed position.
Figure 10A:
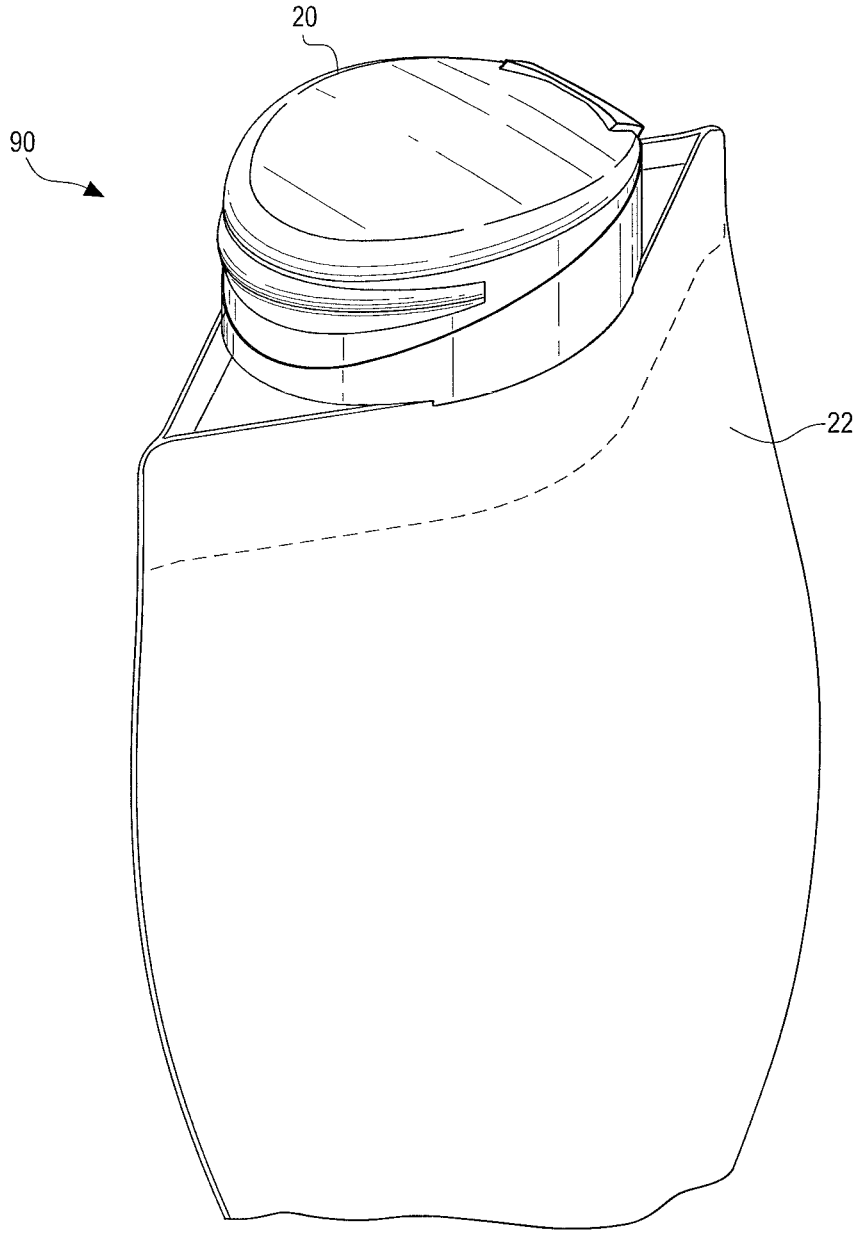
FIG. 10A is an isometric view from the top front and side of a package comprising the fitment of FIGS. 1-10 installed in a flexible, collapsible container in the form of a pouch.

In the preferred embodiment, the fitment 20 is initially molded by the manufacturer with the lid 26 in an open position. Then the manufacturer moves the lid 26 to the closed position. The closed fitment 20 would typically then be shipped to a pouch manufacturer, and the pouch manufacturer would install the fitment 20 on the pouch 22 (FIG. 10A). The pouch 22 may have already been filled with product, or the fitment 20 may be installed on an empty pouch 22 that is subsequently filled with product through an open bottom end of the pouch 22 which is thereafter sealed closed.

It is presently contemplated that most pouch manufacturers will prefer to install the fitment 20 on the pouch 22 with heat sealing techniques or ultrasonic sealing techniques. In an alternate installation process, the fitment 20 could be installed on the pouch 22 with adhesive.

The illustrated first embodiment of the fitment body 24 defines an initially occluded access passage 30, and has inner and outer ends 31 and 32, respectively, as best seen in FIG. 8. The height of the fitment body 24 is defined between the inner end 31 and outer end 32 of the fitment 20. The access passage 30 extends from the inner end 31 through the body 24 and to the outer end 32. When the initially occluded access passage 30 is opened (as described hereinafter), it communicates through the body 24 with the interior of the pouch 22 to permit the contents to be poured from the interior of the pouch 22 through the body 24, or to permit the addition or refilling of a substance into the pouch 22, or to permit the ingress or egress of other substances.

As can best be seen in FIGS. 1 and 2, the fitment body 24 has a boat-like, or generally elongate, shape that is suitable for being sealed at the top opening of the pouch 22 (FIG. 10A). The body 24 has a base 40 that includes a top deck 41 and that includes peripheral side surfaces defining a sealing portion 36 for being attached to the interior of the pouch 22 at the initial opening of the pouch 22. The sealing portion 36 has a major dimension MD (FIGS. 5, 8, and 11) that is oriented generally transverse of the height of the body 24. In the preferred embodiment of the fitment 20, the sealing portion 36 has the form of a boat with a converging bow and stern. However, the fitment sealing portion 36 may have other shapes with a major dimension that is oriented generally transverse of the body height such as an ellipse, oval, elongate polygon, etc.

Referring to FIGS. 5 and 8, the fitment body 24 preferably includes a neck 42 which projects outwardly from the base 40. The access passage 30 (illustrated in FIG. 8) extends through both the base 40 and the neck 42. It will be appreciated that the body 24 may take a variety of forms, and need not have a discernible neck or base at all. Further, it is understood that the access passage 30 and neck 42 need not have generally circular cross-sections as shown. The interior of the access passage 30 and/or neck 42 may be elliptical, polygonal, or some irregular shape. In the preferred embodiment, a portion of the body outer end 32 defined at and by the top of the neck 42 has a peripheral surface 44 (FIG. 5) that is both lateral of the access passage 30 and is sloping in the general direction of the major dimension MD of the body sealing portion 36. The peripheral surface 44 provides an area of engagement for a portion of the lid 26 when the lid 26 is in the closed position.

Figure 11:
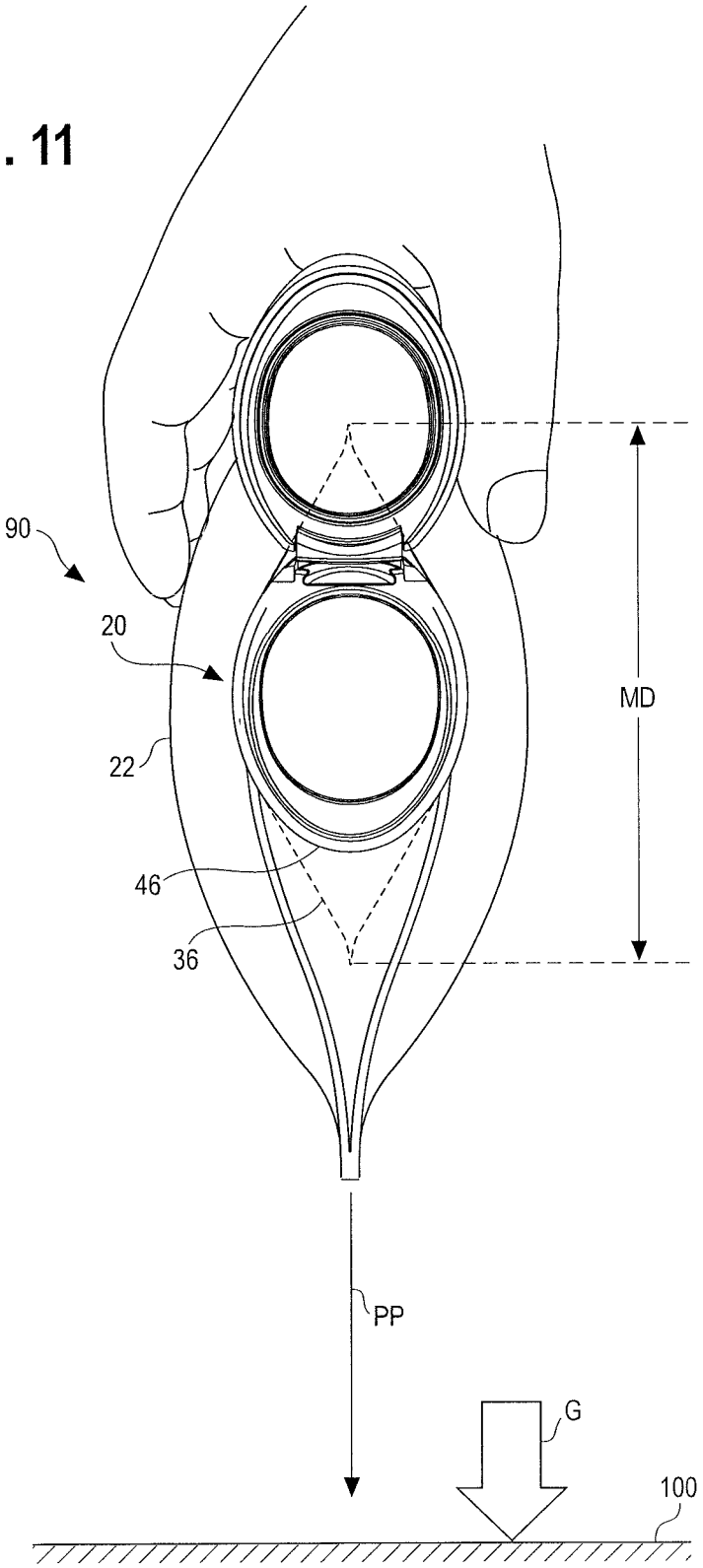
FIG. 11 is a simplified, diagrammatic view of the fitment installed in a container filled with a fluent substance—the fitment, the container, and the fluent substance together defining a package—wherein the fitment is shown with the lid in the open position and the membrane removed from the fitment.

As can best be seen in FIGS. 5 and 8, the fitment 20 has a pour lip 46 extending from the outer end 32 of the body neck 42. The pour lip 46 projects laterally relative to the access passage 30 and defines a pour path PP (in FIG. 11) for the pouch contents flowing out of the interior of the pouch 22 when the user pours the contents from the pouch as discussed in detail hereinafter. In the illustrated first embodiment of fitment 20, the pour lip 46 defines the pour path PP along, or in, the general direction of the major dimension MD of the body sealing portion 36, as is shown in FIG. 11. However, it will be appreciated that according to one aspect of one form of the invention, the pour lip 46 need not define the pour path PP in the general direction of the major dimension MD, and the pour lip 46 may be positioned, for example, asymmetrically on the body outer end 32 with respect to the major dimension MD to define a pour path PP that is not in the general direction of the major dimension MD (such an alternate orientation not being illustrated).

As seen in FIG. 8, the preferred embodiment of the fitment pour lip 46 has an interior surface 48 with a concave portion 50 and a convex portion 52. The convex portion 52 is located further outwardly, with respect to the body inner end 31, than the concave portion 50. It will be appreciated that the pour lip 46 may have an interior surface 48 with other geometries (e.g., a concave arc, a convex arc, one or more connected straight or planar surfaces, etc.).

Figure 6:
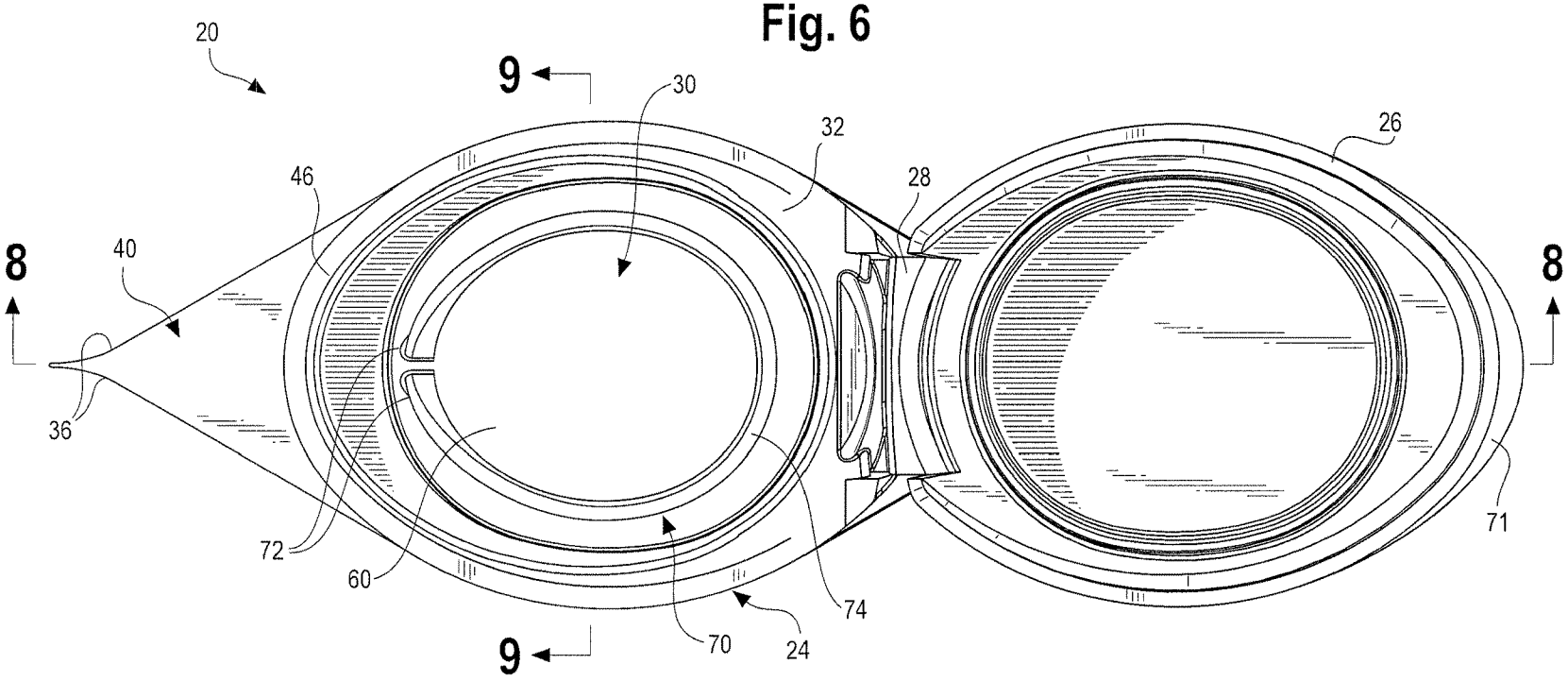
FIG. 6 is a top plan view of the open lid fitment shown in FIG. 3.
Figure 7:
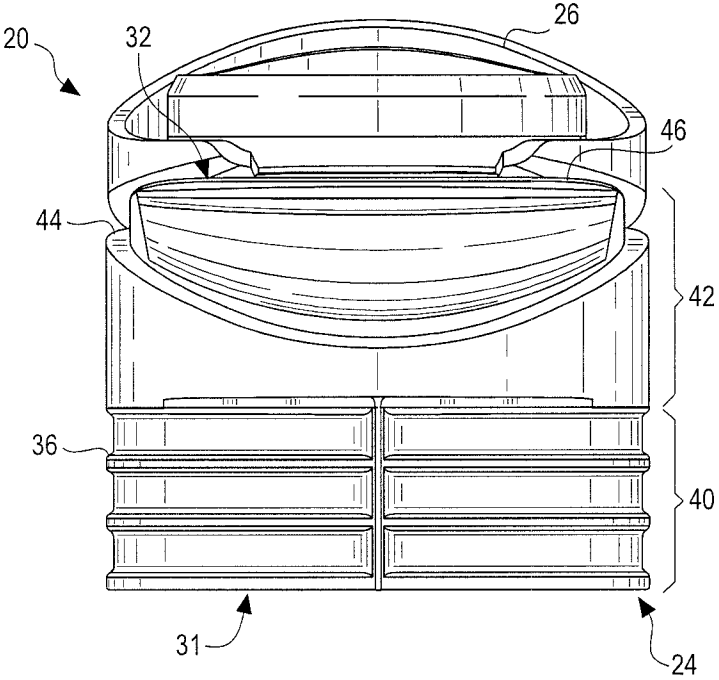
FIG. 7 is a front elevational view of the open lid fitment shown in FIG. 3.

Referring now to FIGS. 4 and 6, the fitment pour lip 46 partially extends around a perimeter of the access passage 30, and extends laterally and axially outwardly from the body neck outer end 32. In one alternate form of the invention, the pour lip 46 may extend fully around the perimeter of the access passage 30 (such a configuration not bring illustrated herein).

Figure 9:
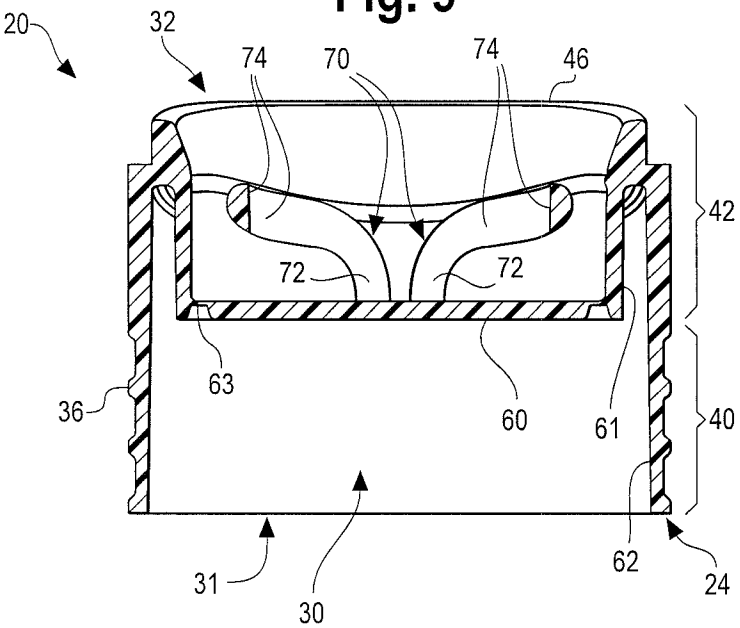
FIG. 9 is a cross-sectional view of the open lid fitment shown in FIG. 3 taken generally along the plane 9-9 in FIG. 6.

As best illustrated in FIGS. 8 and 9, the preferred embodiment of the fitment body 24 includes a separable (i.e., removable) membrane 60 across the access passage 30. The membrane 60 is initially connected to the body 24 so as to initially occlude the access passage 30. The membrane 60 is connected to the rest of the body 24 at an upper, inner wall 61 of the neck 42. However, it will be understood that, alternatively, the inner wall 61 could be omitted, and the membrane 60 may alternatively be connected to the body 24 at a larger diameter outer wall 62 of the access passage 30 (not illustrated). The membrane 60 also may alternatively be provided in the base 40 of the body 24 to occlude the access passage 30 (not illustrated).

Referring still to FIGS. 8 and 9, the membrane 60 preferably includes a peripheral portion 63 that connects to the inner wall 61. In the presently preferred form of the fitment 20, the peripheral portion 63 is a thinned or weakened area or region of reduced cross-sectional thickness compared to a laterally inward portion of the membrane 60. As discussed below, the weakened area permits the user to employ a lower force to remove the membrane 60 from the body 24. After the user has separated the membrane 60 from the body 24, there may be a small remnant (not illustrated) of the peripheral portion 63 that remains attached to the body 24 while most of the membrane 60 remains intact and separated from the body 24. Other means of providing a peripheral portion 63 with a weakened area are contemplated. These means could include the use of material weakening by residual internal stress, subjecting the peripheral portion 63 to dynamic stress, die cutting, scoring, etching, or chemical treating of the peripheral portion 63 to create the weakened area.

In the illustrated preferred embodiment of the fitment 20, the membrane 60 has a separation member 70 (FIGS. 4, 6, and 9) extending outwardly from the membrane 60. The separation member 70 is designed for engagement by a user to separate at least a part of the membrane 60 from the fitment body 24 (as shown in FIG. 11) as explained hereinafter. Complete or partial removal of the membrane 60 would indicate to a subsequent user that at least a portion of the fitment 20 has been breached. Thus, the fitment 20 with the membrane 60 may serve a tamper-evidency function.

In the preferred embodiment, the fitment 20 is initially molded with the lid 26 open and with the separation member 70 in an outwardly projecting "as-molded" configuration (FIG. 4). Then the lid 26 is closed to cover, protect, and conceal the separation member 70 (FIG. 10). The fitment 20 with the lid 26 closed can then be installed on the pouch 22 (FIG. 10A). Subsequently, a user can open the lid 26 to expose the separation member 70. The lid 26 has a lift member 71 extending outwardly from an outer surface of the lid 26 for providing a user with a finger-engaging region or thumb-engaging region or gripping location by which the lid 26 can be moved from the closed position to the open position. The lift member 71 is preferably symmetric about the major dimension MD of the body sealing portion 36 (FIGS. 4-6).

In the illustrated first embodiment of the fitment 20, as best shown in FIGS. 8-9, the separation member 70 includes two stems 72 extending outwardly from the membrane 60. The separation member 70 further includes a partial ring-like grippable portion 74 that extends laterally from the stems 72. A user may grip the portion 74 and remove the membrane 60 easily from the body 24. It will be understood, however, that the separation member 70 need not have a discernible stem 72 or grippable portion 74. The separation member 70 may be of any suitable geometry that will allow a user to separate the membrane 60 from the fitment body 24 by gripping the separation member 70 with a finger, or between user's thumb and finger, or by gripping or hooking it with a tool. The separation member 70 preferably is symmetric about the sealing portion 36 of the fitment body 24 (FIG. 6).

The illustrated first embodiment of the fitment grippable portion 74 has a generally circular or oval configuration (as shown in FIG. 6). However, it will be appreciated that the grippable portion 74 may be provided in a variety of forms such as one or more discontinuous tabs extending from the stems 72. Moreover, the grippable portion 74 may take the form of another shape that is generally circular or an oval, such as a ring, polygon, or other suitable projecting member to be engaged by a user of the fitment 20.

According to one broad aspect of the inventive fitment 20, the fitment 20 need not have any membrane 60 or separation member 70. Alternative means of initially occluding the access passage 30 are contemplated, such as by occluding the access passage 30 with a removable polymeric or foil seal, a plug, or sealing engagement between the lid 26 on the outer end 32 of the body 24 to provide occlusion of the access passage 30, including leak-tight or non-leak-tight sealing of the access passage 30. According to another broad aspect of the invention, for some applications the fitment 20 need not have the capability of sealing, covering or otherwise occluding the access passage 30.

The fitment 20 installed on the pouch 22 containing a product together define a package 90 (FIGS. 10A and 11). For the preferred illustrated embodiment of the fitment 20 having the membrane 60, a user of the package 90 can open the package 90 by first engaging the lift member 71 of the lid 26 to move the lid 26 from the closed position to the open position permitting removal of the membrane 60. Then the user can grip and pull the separation member 70 to separate the membrane 60 from the remainder of the fitment body 24. The user can then grip the package 90 on opposing sides of the major dimension MD of the fitment sealing portion 36, as shown in FIG. 11. The user can then tip the package 90 such that substance (i.e., product) is poured from the pour lip 46 along the pour path PP.

In the preferred embodiment, the fitment major dimension MD and the pour path PP lie along a plane that is parallel to the direction of gravity G. Thus, the substance contained within the pouch 22 is poured from the pour lip 46 of the fitment 20 along the pour path PP in a direction generally along the major dimension MD. This facilitates the holding and manipulation of the flexible, collapsible pouch 20, and accommodates more accurate pouring.

Figure 12:
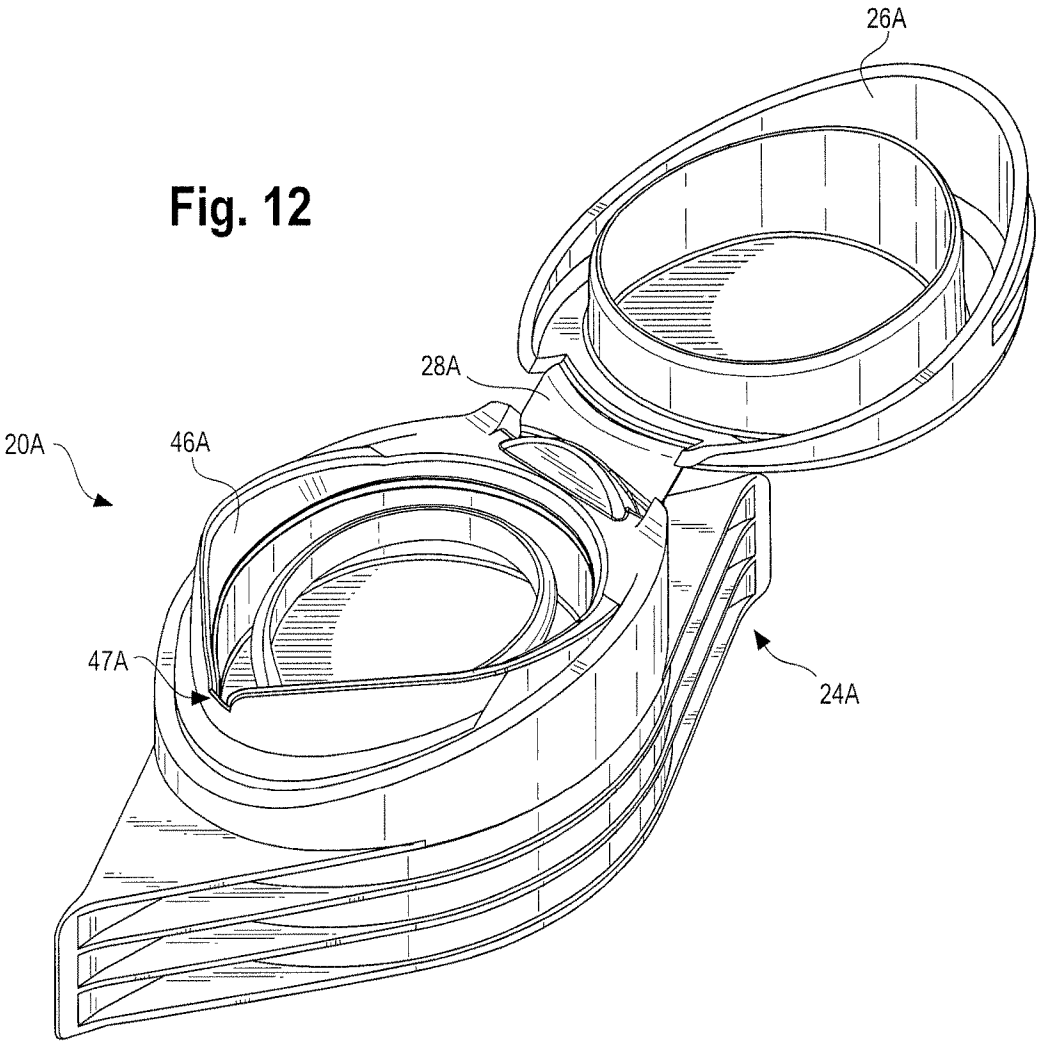
FIG. 12 is an isometric view of another embodiment of a fitment of the present invention shown with the lid open in the as-molded condition prior to the lid being closed and the fitment installed in a container (not shown).

The second "opened" condition of the second embodiment of the fitment 20A, illustrated in FIG. 12, has a different aesthetic design than the opened condition of the first embodiment of the fitment 20. The second embodiment of the fitment 20A operates in an identical manner as described above with respect to the first embodiment of fitment 20. The fitment 20A has a body 24A, lid 26A, hinge 28A, and most other features described above with reference to the fitment 20. However, fitment 20A differs from fitment 20 in that fitment 20A has a pour lip 46A with a different geometry. Pour lip 46A has a generally tapered configuration when viewed from above, and further, pour lip 46A has a channel 47A formed therein.

Although not illustrated, it will be appreciated that the fitment 20, 20A may have other exterior configurations providing various aesthetically desirable designs without affecting the structure and operation of the invention. For example, the configuration of the exterior of the lid 26 could have other or additional features, such as projections, different curved regions, etc.

As discussed above, a preferred aspect of the invention relates to a fitment 20 or 20A having a lip 46 or 46A (which may be unitarily molded with, or separately attached to, the rest of the fitment) wherein the lip 46 or 46A defines pour path PP parallel to the major dimension MD of the fitment sealing portion 36. However, according to another aspect of the invention, an alternate form of the novel fitment (not illustrated) can be provided with a pour lip that can have a different orientation than shown for the preferred embodiment. For example, a novel fitment can be provided with a pour lip defining a pour path generally perpendicular to the major dimension MD of the fitment sealing portion 36. The provision of a fitment with a pour lip can, in various applications, eliminate the need of providing a separate closure with a pour lip (and perhaps other features, such as a cover in the form of a movable cap or hinged lid), and mounting such a separate closure to the fitment. Providing a fitment with a lip eliminates, in some applications, the need to not only provide a separate closure with a pour lip, but would also eliminate the need to position such a closure so as to orient the closure pour lip in a particular direction relative to the fitment.

It will be readily observed from the foregoing detailed description of the invention and from the illustrations thereof that numerous other variations and modifications may be effected without departing from the true spirit and scope of the novel concepts or principles of this invention.

The present invention can be summarized in the following statements or aspects numbered 1-14:

1. A fitment for use with a flexible, collapsible container having an opening to the container interior, said fitment comprising:
   a. an elongate body for being sealed at the opening of a flexible, collapsible container, said body having
      i. an inner end,
      ii. an outer end,
      iii. a height defined between said inner end and said outer end,
      iv. an access passage extending between said inner end and said outer end for communicating with the container interior, and
      v. a sealing portion for being attached to the container interior, said sealing portion having a major dimension generally oriented transversely of said height; and
   b. a pour lip that
      i. extends from said outer end of said body,
      ii. projects laterally relative to said access passage, and
      iii. defines a pour path.
2. The fitment in accordance with aspect 1 wherein said fitment is a unitary molded structure.
3. The fitment in accordance with aspect 1 wherein said pour lip defines said pour path in the general direction of said major dimension of said body sealing portion.
4. The fitment in accordance with aspect 1 where said body includes
   a. a base that defines said sealing portion having said major dimension; and
   b. a neck that
      i. projects from said base to define a portion of said access passage, and
      ii. defines said outer end, and said pour lip extends from said neck and projects laterally from said neck relative to said access passage.
5. The fitment in accordance with aspect 4 wherein a portion of said outer end defined by said neck has a peripheral surface oriented laterally of said access passage, said peripheral surface sloping in the general direction of said major dimension of said body sealing portion.
6. The fitment in accordance with aspect 1 wherein said body further comprises a membrane that
   a. initially occludes said access passage,
   b. is initially connected to a remaining portion of said body, and
   c. includes a separation member that extends outwardly from said membrane for accommodating engagement by a user to separate at least a part of said membrane from said body along at least a portion of the connection of the membrane to the body.
7. The fitment in accordance with aspect 6 wherein said separation member is generally symmetric about said major dimension of said body sealing portion.
8. The fitment in accordance with aspect 1 further comprising a lid to accommodate movement relative to said pour lip between (a) a closed position over said pour lip to occlude flow, and (b) an open position permitting flow.
9. The fitment in accordance with aspect 8 wherein said lid is connected to said body with a hinge.
10. The fitment in accordance with aspect 8 wherein said lid has a lift member extending laterally outwardly from said lid, said lift member providing a user with a gripping location for moving said lid from said closed position to said open position, and said lift member being symmetric about said major dimension of said body sealing portion.
11. The fitment in accordance with aspect 1 wherein said pour lip has an interior surface that includes:
    a. a concave portion; and
    b. a convex portion, said convex portion being located further outwardly than said concave portion.

12. The fitment in accordance with aspect 1 wherein said pour lip extends only partially along a perimeter of said access passage.

13. A package containing a substance that a user can pour, said package comprising:
   a. a flexible, collapsible container having an opening to an interior of said container; and
   b. a fitment positioned at said opening of said container, said fitment having
      i. an elongate body, said body having
         1. an inner end,
         2. an outer end,
         3. a height defined between said inner end and said outer end,
         4. an access passage extending between said inner end and said outer end for communicating with said container interior, and
         5. a sealing portion that is sealed to said container at said container opening, said sealing portion having a major dimension oriented generally transversely of said height; and
      ii. a pour lip that
         1. extends from said body outer end,
         2. projects laterally relative to said access passage, and
         3. defines a pour path.

14. A method of pouring a substance from a package, wherein said package has a flexible, collapsible container with an opening to an interior of said container and a fitment sealed to said container at said opening, wherein said fitment has an elongate body, wherein said body has an inner end, an outer end, a height defined between said inner end and said outer end, an access passage extending between said inner end and said outer end for communicating with said container interior, and a sealing portion that is sealed to said container at said container opening, wherein said sealing portion has a major dimension oriented generally transversely of said height, and wherein said fitment also has a pour lip that extends from said body outer end, projects laterally relative to said access passage, and defines a pour path, the method comprising the steps of:
   a. gripping said package on opposing sides of said major dimension; and
   b. tipping said package such that said fitment major dimension and said pour path are defined by a plane that is parallel to the direction of gravity to pour said substance from said pour lip of said fitment in a direction generally in said plane.

What is claimed is:

1. A fitment for use with a flexible, collapsible container having an opening to the container interior, said fitment comprising:
   a. an elongate body for being sealed at the opening of a flexible, collapsible container, said body having
      i. an inner end,
      ii. an outer end,
      iii. a height defined between said inner end and said outer end,
      iv. an access passage extending between said inner end and said outer end for communication with the container interior, and
      v. a sealing portion for being attached to the container interior, said sealing portion having a major dimension generally oriented transversely of said height;
   b. a pour lip that
      i. extends from said outer end of said body,
      ii. protects laterally relative to said access passage, and
      iii. defines a pour path; and wherein said body further comprises a membrane that
   a. initially occludes said access passage,
   b. is initially connected to a remaining portion of said body, and
   c. includes a separation member that extends outwardly from said membrane for accommodating engagement by a user to separate at least a part of said membrane from said body along at least a portion of the connection of the membrane to the body, and ail of said separation member is located axially inward of a laterally outermost end of said pour lip.

2. The fitment of claim 1 wherein said separation member is generally symmetric about said major dimension of said body sealing portion.

3. A fitment for use with a flexible, collapsible container having an opening to the container interior, said fitment comprising:
   a. an elongate body for being sealed at the opening of a flexible, collapsible container, said body having
      i. an inner end,
      ii. an outer end,
      iii. a height defined between said inner end and said outer end,
      iv. an access passage extending between said inner end and said outer end for communication with the container interior, and
      v. a sealing portion for being attached to the container interior, said sealing portion having a major dimension generally oriented transversely of said height;
   b. a pour lip that
      i. extends from said outer end of said body,
      ii. protects laterally relative to said access passage, and
      iii. defines a pour path;

wherein said pour lip has an interior surface that includes:
   a. a concave portions; and
   b. a convex portion, said convex portion being located further outwardly than said concave portion; and wherein said body further comprises a membrane that
   a. initially occludes said access passage,
   b. is initially connected to a remaining portion of said body, and
   c. includes a separation member that extends outwardly from said membrane for accommodating engagement by a user to separate at least a part of said membrane from said body along at least a portion of the connection of the membrane to the body, and all of said separation member is located axially inward of said convex portion of said pour lip.

4. A fitment for use with a flexible, collapsible container having an opening to the container interior, said fitment comprising:
   a. an elongate body for being sealed at the opening of a flexible, collapsible container, said body having
      i. an inner end,
      ii. an outer end,
      iii. a height defined between said inner end and said outer end,
      iv. an access passage extending between said inner end and said outer end for communicating with the container interior, and
      v. a sealing portion for being attached to the container interior, said sealing portion having a major dimension generally oriented transversely of said height;

b. a pour lip that i. extends from said outer end of said body, ii. projects laterally relative to said access passage, and iii. defines a pour path;

wherein said pour lip has an interior surface that includes:

a. a concave portion; and b. a convex portion, said convex portion being located further outwardly than said concave portion; and wherein said body further comprises a membrane that a. initially occludes said access passage, b. is initially connected to a remaining portion of said body, and c. includes a separation member that extends outwardly from said membrane for accommodating engagement by a user to separate at least a part of said membrane from said body along at least a portion of the connection of the membrane to the body, and all of said membrane is located axially inward of said concave portion of said pour lip.

* * * * *